US011903503B2

(12) United States Patent
Sinclair

(10) Patent No.: US 11,903,503 B2
(45) Date of Patent: Feb. 20, 2024

(54) HANGER DEVICE

(71) Applicant: Ronald Bryn Sinclair, Edmonds, WA (US)

(72) Inventor: Ronald Bryn Sinclair, Edmonds, WA (US)

( * ) Notice: Subject to any disclaimer, the term of this patent is extended or adjusted under 35 U.S.C. 154(b) by 0 days.

(21) Appl. No.: 17/880,711

(22) Filed: Aug. 4, 2022

(65) Prior Publication Data

US 2022/0369838 A1 Nov. 24, 2022

Related U.S. Application Data

(63) Continuation-in-part of application No. 17/669,884, filed on Feb. 11, 2022, now abandoned.

(60) Provisional application No. 63/148,634, filed on Feb. 12, 2021.

(51) Int. Cl.
*A47G 25/32* (2006.01)

(52) U.S. Cl.
CPC ..... *A47G 25/32* (2013.01)

(58) Field of Classification Search
CPC .... A47G 25/18; A47G 25/183; A47G 25/186; A47G 25/1442; A47G 25/145; A47G 25/1457; A47G 25/1471; A47G 25/16; A47G 25/28; A47G 25/30; A47G 25/32; A47G 25/325
USPC ..... 223/85, 88, DIG. 4
See application file for complete search history.

(56) References Cited

U.S. PATENT DOCUMENTS 1,828,975 A * 10/1931 Magarian ..... A47G 25/28 223/88
2,475,992 A * 7/1949 Schliestedt ..... A47G 25/52 223/91
2,549,588 A * 4/1951 Fillenbaum ..... A47G 25/18 223/88
2,820,274 A * 1/1958 Ballentine ..... A47G 25/32 24/698.3
2,864,147 A * 12/1958 Solow ..... A47G 25/32 D6/318

(Continued)

OTHER PUBLICATIONS

"PSDR Cabinet Spray & Drying System," paintlifesupply.com, https://paintlifesupply.com/collections/game-changers/products/prodryingrack-sd [Date accessed: Aug. 29, 2020].

(Continued)

*Primary Examiner* — Nathan E Durham
(74) *Attorney, Agent, or Firm* — Bold IP, PLLC; Binita Singh

(57) ABSTRACT

A hanger is provided that remains relatively stable and does not rotate in a direction a hanging rod extends from which the hanger is suspended. The hanger comprises a top hook which is configured with multiple straight sides with adjacent straight sides connected at angles, wherein two adjacent sides are connected at an angle via a high point, wherein the high point is a highest point of the top hook. The two adjacent straight sides connected via the high point are arranged to contact the hanging rod on opposing sides when suspended from the hanging rod. The top hook is connected to one or more arms which are connected to base. The base includes a wavy portion which includes one or more peaks and one or more low points, wherein a first low point is configured at a midpoint of the base and the first low point is in line with the high point of the top along a centerline.

11 Claims, 8 Drawing Sheets

(56) References Cited

U.S. PATENT DOCUMENTS

| | | | | | |
|---|---|---|---|---|---|
| 3,029,990 | A * | 4/1962 | Roberts | A47G 25/16 | 223/88 |
| 3,138,259 | A * | 6/1964 | Sitt | A47F 7/02 | 211/85.2 |
| 3,406,882 | A * | 10/1968 | Phillips | A47G 25/28 | D6/315 |
| 3,907,118 | A | 9/1975 | Pelavin | | |
| D278,291 | S | 4/1985 | Gurule | | |
| 5,303,855 | A * | 4/1994 | Veale | A47G 25/40 | 223/88 |
| 7,320,419 | B1 | 1/2008 | Finamore | | |
| 7,731,068 | B2 | 6/2010 | Scicluna | | |
| D702,049 | S | 4/2014 | Lazri | | |
| 8,991,666 | B2 | 3/2015 | Mazyck | | |
| 9,027,804 | B2 | 5/2015 | Barre et al. | | |
| D843,740 | S | 3/2019 | Peterson et al. | | |
| D869,864 | S * | 12/2019 | Li | D6/319 | |
| 2004/0069819 | A1* | 4/2004 | Strouts | A47G 25/743 | 223/85 |

OTHER PUBLICATIONS

"HME Products Game Hanging Gambrel," Amazon.com. https://www.amazon.com/dp/B000UNKPZC?tag=picclick0f-20&linkCode=osi&th=1&psc=1 [Date accessed: Oct. 9, 2020].

* cited by examiner

HANGER DEVICE

CROSS-REFERENCE TO RELATED APPLICATION

This application is a continuation-in-part application which claims priority to the non-provisional application Ser. No. 17/669,884 filed on Feb. 11, 2022, which claims priority to U.S. Provisional Patent Application No. 63/148,634 filed on Feb. 12, 2021, which are incorporated by reference in their entirety.

FIELD OF DISCLOSURE

The present invention relates to the field of hangers, and more particularly to a hanger for preventing rotation while suspended from a hanging rod.

BACKGROUND

Painters, woodworkers, and others who work with materials that need to be painted or sealed often need to paint or seal all sides of an object. Painting or sealing an object laid on a surface, like a workbench, must have time to dry after a first side is painted before being flipped over to paint or seal the opposite side. This can cause significant delays and require a very large work area. One solution to this problem is suspending the object that needs to be painted or sealed so that all sides of the object can be painted or sealed at once without needing to wait for parts of the paint or sealant to dry. However, current methods of hanging the objects needing to be painted or sealed are inefficient in space because the objects can easily sway and move around while suspended from a single hanging rod. Securing an object needing to be painted to multiple hanging rods is laborious when compared to securing the object to a single rod. If the suspended objects touch before the paint or sealant is dry, the aesthetic look of the object may be ruined. Many workmen use a single hanging rod and leave large amounts of space between the painted or sealed objects while they dry to avoid contact between the objects as they dry.

Accordingly, there is still an unsolved need for a hanging device that may address these issues and other existing issues.

SUMMARY

One or more embodiments are provided below for a device that provides a hanger that reduces rotational movement of the hanger. The hanger device may include a top hook which is arranged to contact a hanging rod at two points to reduce rotational motion of the hanger on the hanging rod when the hanger device is suspended from the hanging rod. The hanger device is suspended from and supported on the hanging rod and is perpendicular to the direction the hanging rod expends.

In one embodiment, the hanger comprises a top hook configured with multiple straight sides, wherein the adjacent straight sides are connected at an angle with two adjacent sides connected via a high point, wherein the high point is a highest point of the top hook, and wherein the two adjacent straight sides connected via a high point are arranged to contact a hanging rod on opposing sides when suspended from the hanging rod. The top hook is connected to two arms which extend laterally from the top hook. The two arms extend laterally and connect to a base. The base may be configured with a wavy portion, wherein the wavy portion is configured with at least two peaks and one or more low points, wherein the one or more low points are a local minimum within the wavy portion, wherein a first low point is a center point of the wavy portion with one or more peaks extending up on either side of the first low point. The hanger is symmetrical across a centerline which may be defined as where the high point of the top hook aligns with the first low point.

The hanger may also comprise one or more side hooks which are connected to the two arms, wherein each of the two arms is connected to one or more side hooks, and the one or more side hooks each including second low points which are local minima with the side hooks. The one or more side hooks may extend down and away from the connection with the arms and then turn upward at an angle creating the second low point. The second low point may be below the base. In an alternate embodiment, the one or more side hooks may extend upward at an angle from the connection with the two arms such that the second low point is in line with the base. The one or more low points on the base and the second low points on the side hooks create points where items may be hung from and providing stable contact points.

The disclosed hanger is unique in that it is structurally different from other known devices or solutions. More specifically, the hanger is unique due to the presence of: (1) the shaped top hook which is arranged to contact a support rod at two points to reduce rotational motion of the hanger on the hanging rod in the direction the hanging rod expends; and (2) the low point of the base along with the side hooks are arranged to provide a stable contact point for objects to be suspended from the hanger and reduce the chances of the object sliding sideways.

DETAILED DESCRIPTION

In the Summary above, in this Detailed Description, the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used—to the extent possible—in combination with and/or in the context of other particular aspects and embodiments of the invention, and in the invention generally.

The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose limits include both numbers. For example, "25 to 100" means a range whose lower limit is 25 and upper limit is 100 and includes both 25 and 100.

Figure 1:
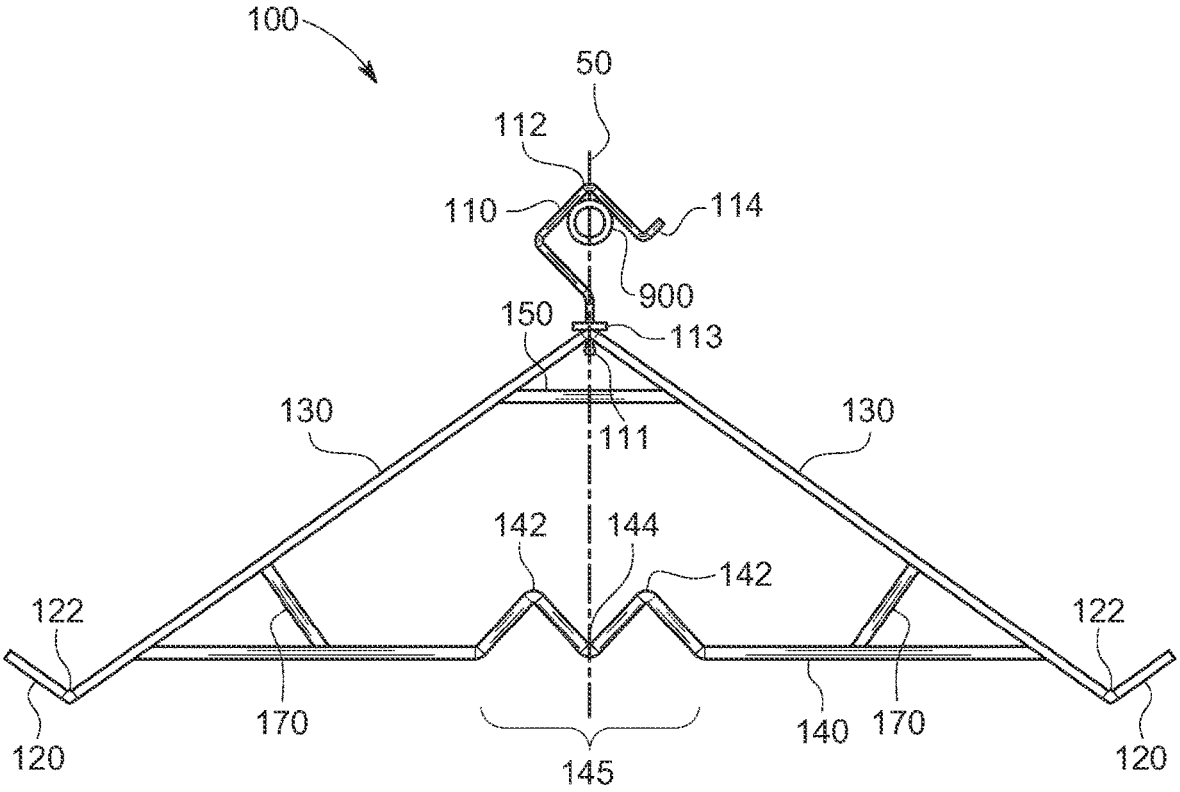
FIG. 1 shows an example front view of a hanger.

FIG. 1 shows an example front view of a hanger 100. The hanger 100 may comprise of a top hook 110, one or more side hooks 120, two arms 130, a base 140, a support 150, and one or more braces 170. All the components of the hanger 100 may extend in a single plane such that the hanger 100 is mainly flat. The hanger 100 may be constructed similarly to traditional hangers to the end that the two arms 130 are connected to the top hook 110 with the two arms 130 extending laterally from the top hook 110 to connect to the base 140.

The top hook 110 is for suspending the hanger 100 from a hanging rod 900. The top hook 110 may be made of a metal or other durable material including and not limited to plastic and carbon fiber. The top hook 110 may include a high point 112 where the top hook 110 comes to a point, or near a point, and is a highest point of the top hook 110 and the hanger 100 when the hanger 100 is suspended from the hanging rod 900. The top hook 110 may have an angled shape with multiple straight sides, with adjacent straight sides connected at an angle. The angle of the straight sides coming to the top point 112 may be about 60 degrees to about 120 degrees. In one embodiment, the angle of the straight sides coming to the top point 112 may be about 90 degrees. The straight sides on the top hook 110 that connect to form the high point 112 contact the hanging rod 900 at two points when suspended from the hanging rod 900. The adjacent straight sides of the top hook 110 connecting at the high point 112 may connect at an angle such that when the top hook 110 is placed on a hanging rod 900 (shown in cross section) the top hook 110 contacts the rod 900 at two points. Specifically, each of the top hook's 110 adjacent straight sides connecting at the high point 112 contact the hanging rod 900 and the ability of the top hook 110 to rotate in the direction in which the rod 900 extends is significantly reduced when compared to a single point of contact (as would be the case if a standard hanger with a curved top shape was used). Rotation in the plane perpendicular to the direction in which the rod 900 extends, i.e., rotation around the rod 900, is also reduced by the two points of contact on the top hook 110. However, this direction of rotation is less concerning because an object suspended from the hanger 100 on the rod 900 will be parallel to other objects suspended from additional hangers 100 wherein all the objects on their respective hangers 100 will be perpendicular to the direction in which the rod 900 extends. Thus, rotation of the objects on the hangers 100 will be in the perpendicular plane around the rod 900 and would not cause the objects to collide.

To reiterate, the top hook 110 has a shape that creates two points of contacts between the top hook 110 and the hanging rod 900 that the hanger 100 is suspended from and thus these two points of contact significantly reduce rotation of the hanger 100 in the direction the hanging rod 900 extends. Advantageously, objects hung from the hanger 100 do not rotate in the direction the hanging rod 900 extends resulting in the hung objects from touching each other. Also, advantageously, more objects may be hung on the hanging rod 900 by being placed closer to each other on the hanging rod 900 than would be possible with conventional hangers with the conventional hanger rotating in the direction the hanging rod extends. With conventional hangers, objects would need to be placed further apart from each other to allow enough room for the objects to rotate around a hanging rod in the direction the hanging rod extends to avoid objects touching each other when the convention hanger rotates on the hanging rod.

In some embodiments, the hanger 100 may also comprise an anchor piece 114 which is connected to the top hook 110. The anchor piece 114 is connected to an end of the top hook 110 opposite an end that connects to the two arms 130. The anchor piece 114 extends upward and away from the top hook 110 at an angle. The anchor piece 114 is arranged at an angle that permits a cord (see, FIG. 8, cord 35) to be tied around the top hook 110 when an object is hung from the hanger 100 from the hanging rod 900. The cord may be looped relatively tightly around the top hook 110 and the angle where the top hook 110 and the anchor piece 114 are connected to prevent the straight sides of the top hook 110 from extending wider. The cord adds additional support to the top hook 110 of the hanger if the suspended object is heavy and thus prevent the top hook 110 from extending wider with the weight of the object.

The hanger 100 also comprises of one or more side hooks 120 which may connect to the two arms 130. Each of the two arms 130 may be connected to at least one side hook 120. The side hooks 120 may extend out from each of the two arms 130 and provide a second low point 122 where an object can be secured to the hanger 100. The second low point 120 may be a local minimum within the side hooks 120. In some embodiments, the side hooks 120 may extend down and away from the connection with the arms 130 and then turn upward at an angle creating the second low point 122. The one or more side hooks 120 extend relatively in a straight line from the two arms 130 before turning upward. In such an example embodiment, the low point 122 may be below the two arms 130 and the base 140. The side hooks 120 and the arms 130 may be made of metal or another strong and durable material. In some example embodiments, each side hook 120 including the second low point 122 may be an extension of the two arms 130, wherein a single material piece includes one of the arms 130 with the side hook 120 and the second low point 122 being caused by a bend in the material piece. In other example embodiments, each side hook 120 may be welded on to an arm 130 or the base 140. In yet another example embodiment, the side hooks 120 and base 140 may be part of a single wire with the second low points 122 caused by bends in the wire. The second low points 122 may be local minima within the side hook 120 and the arms 130 extending up on either side.

The two arms 130 may each connect to the top hook 110 and extend downward and outward from the top hook 110.

The connection of the top hook 110 and the two arms 130 may be such that the two arms 130 may rotate 360-degrees perpendicular to the centerline 50. As seen in FIG. 1, the top hook 110 has a ball 111 and a stopper 113 opposite each other at the connection with the two arms 130. The ball 111 is below the connection with the two arms 130 and the stopper 113 is above the connection with the two arms 130 such as to allow the two arms to rotate 360 degrees and prevent the top hook 110 move up and down at the connection with the two arms 130. The rotation of the two arms 130 at the connection with the top hook 110 allows a user to suspend an object from the hanger 100, paint a side of the object, rotate the two arms 130 which in turn rotate the suspended object exposing the other side which can then be painted. It is to be understood that the top hook 110 and the two arms may also have a stationary connection, wherein the arms do not rotate.

The two arms 130 may connect to the side hooks 120 (as described above) and the base 140. The two arms 130 may be straight. Each arm 130 may connect to the base 140 at the point where the one or more side hooks 120 also connect, so the one or more side hooks 120 may be connected to the arm 130 or the base 140 or both. In some embodiments, the side hook 120 may be a portion of the base 140 or the arm 130 that is bent upwards to form the low point 122. The side hooks may extend below the base 140 with the low point 122 below the base 140. Each of the two arms 130 and the base 140 may connect at an angle of about 30 to 60 degrees. In one embodiment, the arms 130 may connect to the base 140 at an angle of 45 degrees. The two arms 130 may connect to each other at the point where they connect to the top hook 110 at an angle of about 60 to 120 degrees. In one embodiment, the two arms 130 may connect to each other at the top hook 110 at an angle of 90 degrees.

The base 140 may be fashioned from a metal or other strong and durable material. The base 140 may generally be straight and having two opposing ends that connect to the two arms 130 on the same plane. In some embodiments, the base 140 may be straight and include a wavy portion 145. The wavy portion 145 may be relatively in a center of the base 140, which is midway between the arms 130. The wavy portion 145 may include at least two peaks 142 and one or more low points 144. Each of the at least two peaks 142 and the one or more low points 144 have an angle wherein the one or more peaks 142 have an angle pointing away from the top hook 110 and the one or more low points 144 have an angle pointing toward the top hook 110. The wavy portion 145 includes one low point as a center point within the wavy portion 145, which may be referred to as a first low point 144 and having an equal number of peaks 142 on either side of the first low point 144. In an example embodiment shown in FIG. 1, the wavy portion 145 of the base 140 includes two peaks 142 and a first low point 144 between the two peaks 142. The wavy portion 145 may be formed as part of the base 140 by any means including and not limited to bending a material used to fashion the base 140, welding pieces of a material used to make the base 140, forming a plastic material in the wavy shape, or connecting materials in the shape of the wavy portion 145.

As shown in FIG. 1, the first low point 144 may be a local minimum within the wavy portion 145 extending up to form one peak 142 on either side of the low point 144. The low point 144 may be aligned with the high point 112 of the top hook 110 along a centerline 50 running through the center of the hanger 100. The arms 130, the base 140, and the side hooks 120 may be symmetrical around the centerline 50. This alignment will cause an object hung from the low point 144 only to be most stable because the hanger 100 will be evenly balanced (a very slight imbalance from the shape and weight distribution of the top hook 110 may exist but this has a negligible effect). Also, this alignment causes the top hook 110 to contact the hanging rod 900 at two points equal in distance from the high point 112 of the top hook 110 which gives the greatest reduction in rotational movement.

The wavy portion 145 may have an "M" shape. The "M" shape provides improved resiliency to bending under the weight of an object suspended at the low point 144 than a "V" shape, especially if the low point 144 is at the same level or higher than (from the perspective of the view of FIG. 1) the connections between the base 140 and the two arms 130. The wavy portion 145 with a "V" shape or "M" shape with a first low point 144 below the level of the connections between the base 140 and the two arms 130 would be possible with sufficiently robust support, either from the thickness of the material used in the base 140 and/or the inclusion of the braces 170.

The support 150 may also comprise part of the hanger 100. The support 150 connects to the two arms 130 and is positioned between the two arms 130 relatively proximal to where the two arms 130 connect to the top hook 110. The support 150 may be a relatively straight piece and may be connected to the arms such that the support 150 and the base 140 are parallel to each other. The support 150 offers structural support to the two arms 130 and the overall structure of the hanger 100. The support 150 may also be connected to the two arms 130 at a certain distance from where the two arms 130 connect to the top hook 110 that allows the support 150 and the two arms 130 to function together as a bottle opener, or bottle cap remover. A bottle cap on a bottle may be placed partially in the space between the support 150 and the two arms 130 with a lower lip of the bottle cap contacting the support 150. A person may then rotate the bottle with the bottle cap relative to the hanger 100 and the support 150 with the two arms 130 may secure and remove the bottle cap from the bottle. The support 150 may have a surface with relatively high friction to assist in securing the bottle cap. The support 150 may be fashioned from a metal or other strong and durable material.

The hanger 100 also comprises of one or more braces 170 which may connect to the two arms 130 and the base 140. In an example embodiment shown in FIG. 1, at least one brace 170 is placed relatively near each of a connection between the arms 130 and the base 140. The one or more braces 170 are connected to the two arms 130 and the base 140 to support the base 140 when an object is suspended from the base 140. The one or more braces 170 provide structural support to prevent a bending of the base 140 due to the force of the weight of the object suspended from the base 140 (at the low point 144 or any other point).

All the elements comprising the hanger 100 may be fashioned from metal components connected by welding, rivets, or other connectors. Alternatively, these elements may be made of molded plastics or formed of carbon fiber. Further, several of these components may be part of a single component shaped by bending, molding, etc. (as appropriate for the material used) to form the shape of the hanger 100. The hanger 100 may be scaled to any size and for supporting objects of any weight. For many household objects needing to be painted or sealed on all sides (such as cabinet doors, furniture legs, etc.), a hanger 100 with a base 140 of 8 to 18 inches may be used. The top hook 110 may have a size based on the size of the rod 900 it is intended to be suspended from. For example, if the intended hanging rod 900 has a diameter of 2 inches, the hook may have straight sides of about 3 inches each. The thickness of the material used for the hanger 100 may depend on the intended use of the hanger. For example, if the hanger 100 is constructed entirely of metal components, the thickness of the metal for a hanger 100 intended for use with objects under 2 pounds may use 14.5-gauge wire, while a hanger 100 intended for heavier objects may use considerably heavier gauge wire or sheet metal.

Figure 2:
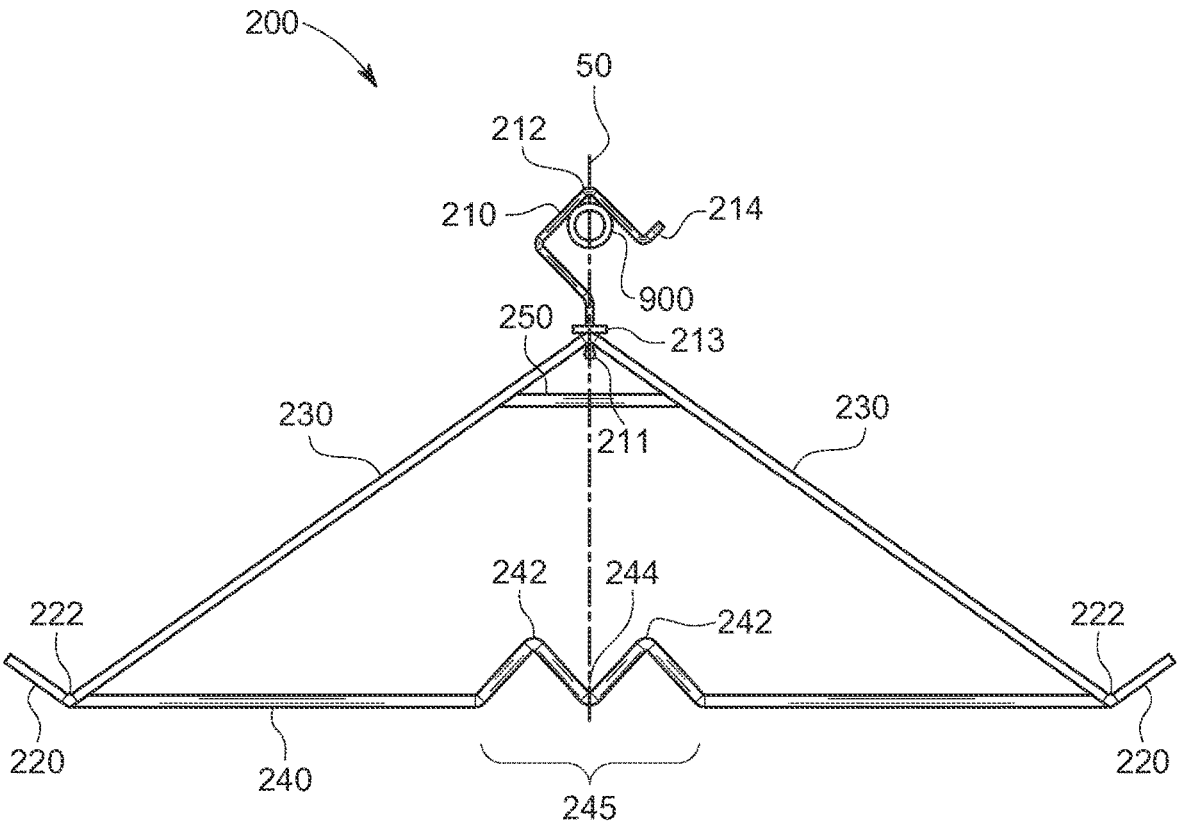
FIG. 2 shows another example front view of a hanger.

FIG. 2 shows a front view of an alternative example embodiment of a hanger 200. The hanger 200 comprises of a top hook 210 with a high point 212, an anchor piece 214, two arms 230, one or more side hooks 220, a base 240 with a wavy portion 245, and a support 250. The top hook 210 is also configured with a ball 211 and a stopper 213 at a connection with the two arms 230 to allow a 360-degree rotation of the two arms 230. An alternate to this embodiment, may include a stationary connection of the top hook 210 to the two arms 230. The wavy portion 245 includes at least two peaks 242 and the one or more low points 244. As shown in FIG. 2, the hanger 200 does not include one or more braces (see, FIG. 1, one or more braces 170). However, it is to be understood that the hanger 200 may be configured with the one or more braces. As seen in FIG. 2, the side hooks 220 may immediately extend up and away from where the arms 230 connect to the base 240 such that a low point 222 is at the connection point between the side hooks 220 and where the arms 230 connect to the base 240. It is also shown that the hanger 200 in this example includes the anchor piece 214. However, it is to be understood that this embodiment may not include the anchor piece.

Figure 3:
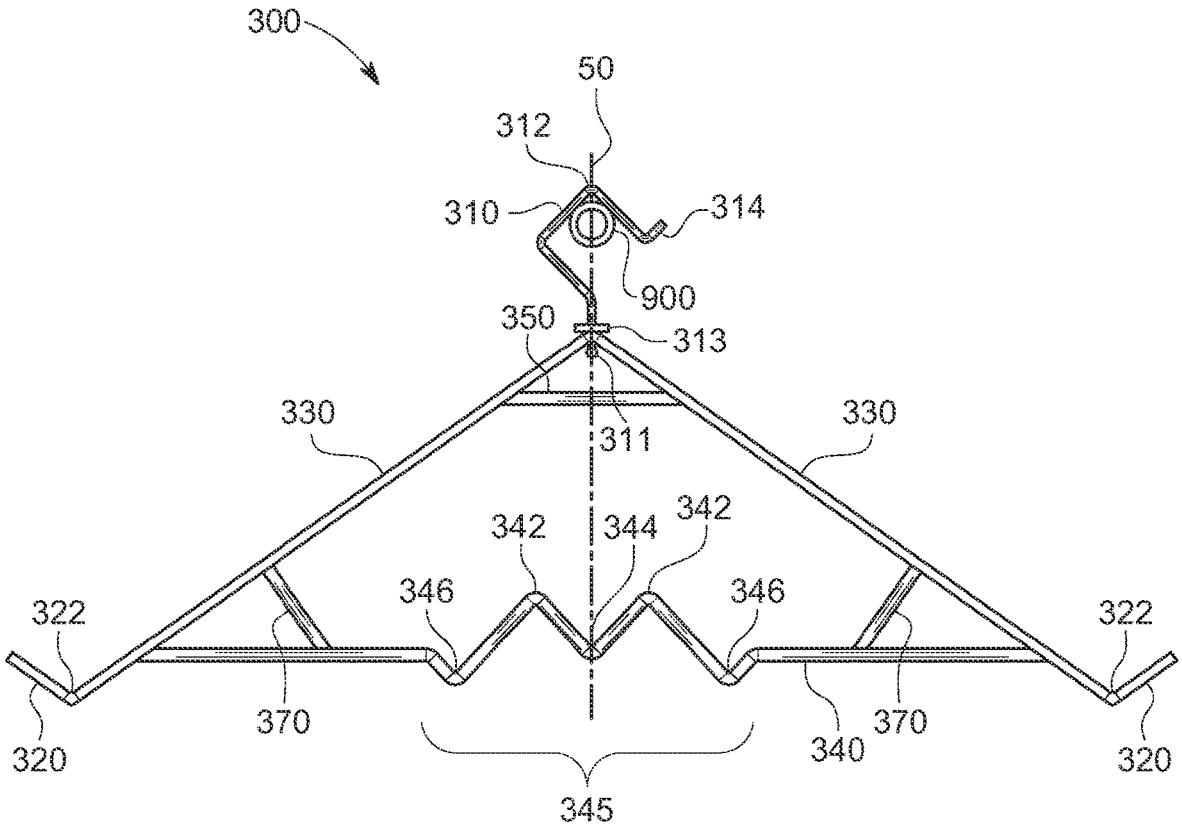
FIG. 3 shows another example front view of a hanger.

FIG. 3 shows another example front view of a hanger 300. The hanger 300 comprises of a top hook 310 with a high point 312, an anchor piece 314, two arms 330, one or more side hooks 320, a base 340 with a wavy portion 345, a support 350, and one or more braces 370. The top hook 310 is also configured with a ball 311 and a stopper 313 at a connection with the two arms 330 to allow a 360-degree rotation of the two arms 330. An alternate to this embodiment, may include a stationary connection of the top hook 310 to the two arms 330. The wavy portion 345 of the hanger 300 includes at least two peaks 342, one or more low points 344, and one or more secondary low points 346 which are configured on a side of the peaks 342 opposite to the first low point 344 at a center of the base 340. The secondary low points 346 may be provided at a point lower than the first low point 344, wherein the secondary low points 346 are below a plane of the base 340. The secondary low points 346 may be useful as providing two points of contact for hanging objects that are smaller than a length of the base 340 in at least one dimension. For example, it may be desired to secure a top of a furniture leg (that connects to a table such that the top surface is obscured from view when connected) using a pair of hooks screwed into the top surface of the furniture leg.

Figure 4:
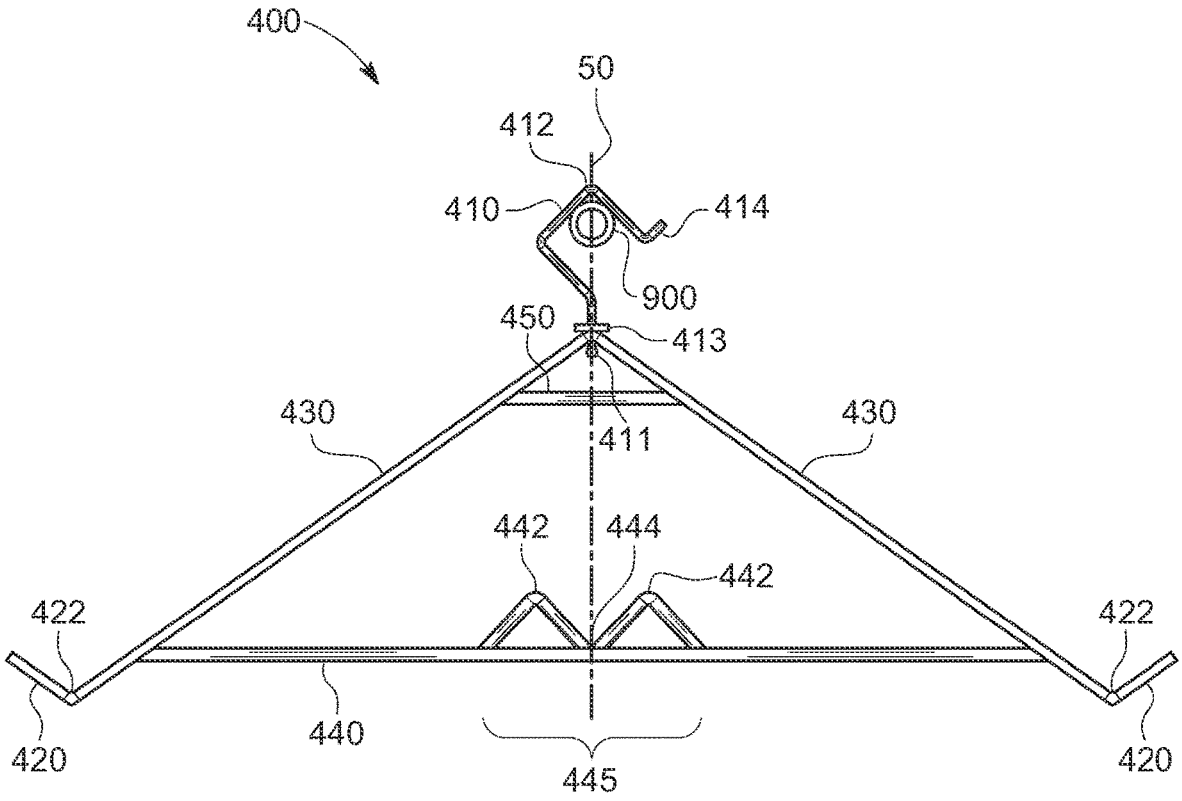
FIG. 4 shows another example front view of a hanger.

FIG. 4 shows another example front view of a hanger 400. The hanger 400 comprises of a top hook 410 with a high point 412, an anchor piece 414, two arms 430, one or more side hooks 420, a base 440 with a wavy portion 445, and a support 450. The top hook 410 is also configured with a ball 411 and a stopper 413 at a connection with the two arms 430 to allow a 360-degree rotation of the two arms 430. An alternate to this embodiment, may include a stationary connection of the top hook 410 to the two arms 430. The base 440 of the hanger 400 may include the wavy portion 445 which is configured onto the base 440. In this example embodiment, the base 440 is configured as a straight continuous piece having two opposing ends which are connected to the arms 430. The wavy portion 445 still includes at least two peaks 442 and one or more low points 444 wherein the at least two peaks 442 and the one or more low points 446 are connected to the base 440. As shown in FIG. 4, the wavy portion 445 is comprised of two peaks 442 and one low point 444 wherein each is connected to the base 440. In configuring the hanger 400 with a continuous straight base 440 with the wavy portion 445 connected on top, the relative strength and rigidity of the base 440 and the hanger 400 is increased.

Figure 5A:
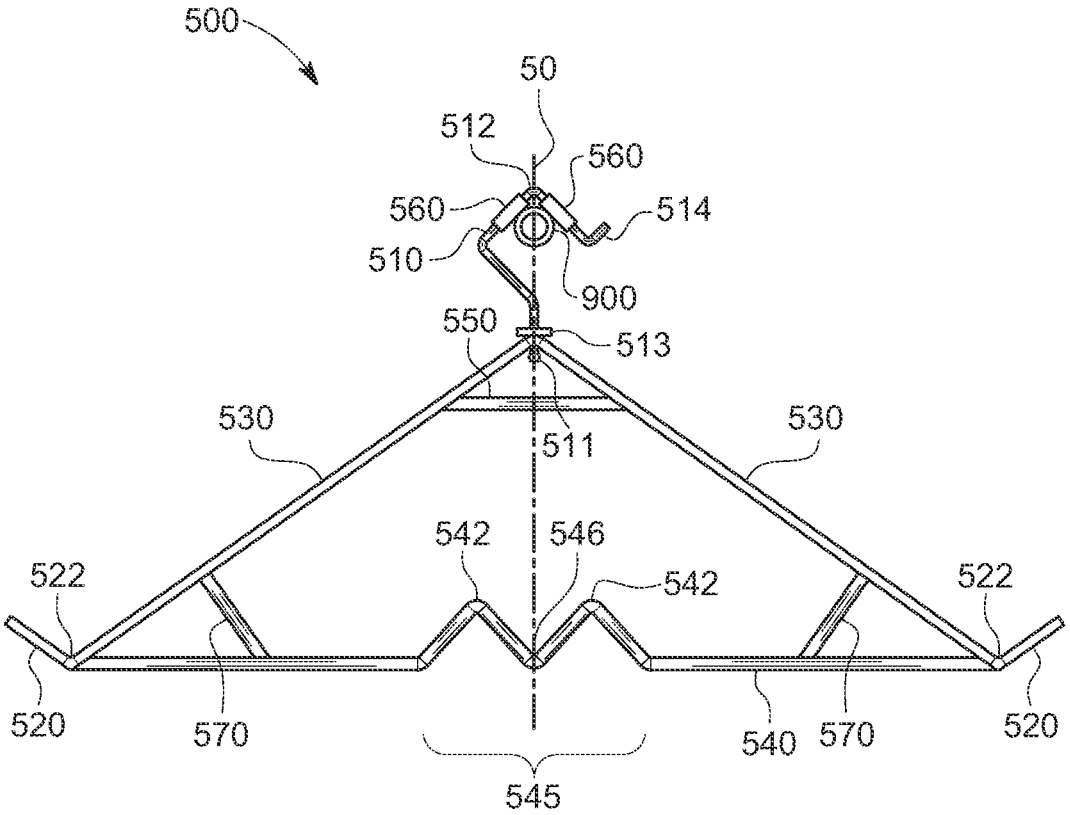
FIG. 5A shows another example front view of a hanger.

FIG. 5A shows another example front view of a hanger 500. The hanger 500 is similar to the hanger described in FIG. 2 (i.e., the hanger 200), wherein the hanger 500 comprises of a top hook 510 with a high point 512, an anchor piece 514, two arms 530, one or more side hooks 520, a base 540 with a wavy portion 545, a support 550, and one or more braces 570. The top hook 510 is also configured with a ball 511 and a stopper 513 at a connection with the two arms 530 to allow a 360-degree rotation of the two arms 530. An alternate to this embodiment, may include a stationary connection of the top hook 510 to the two arms 530. The wavy portion 545 includes at least two peaks 542 and one or more low points 546. Like the hanger 200 in FIG. 2, the side hooks 520 may immediately extend up and away from where the arms 530 connect to the base 540 such that a low point 522 is at the connection point between the side hooks 520 and where the arms 530 connect to the base 540. In this embodiment, the hanger 500 may include one or more rollers 560 on the top hook 510. The one or more rollers 560 may be arranged to directly contact the hanging rod 900 when the hanger 500 is hung on the rod 900. The one or more rollers 560 may be arranged on the straight sides of the top hook 510 that are adjacent to each other and are connected at the high point 512 of the hanger 500. The one or more rollers 560 may have a cylindrical shape. The one or more rollers 560 may allow the hanger 500 to move laterally along the length of the rod 900 more easily than if the rollers 560 were not included. This may help make movement along the rod 900 easier and reduce swaying of an object suspended from the hanger 510 while moving.

Figure 5B:
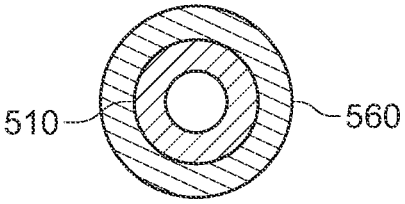
FIG. 5B shows an example cross section view of the roller on the top hook.

FIG. 5B shows an example cross section view of the roller 560 on the top hook 510. The roller 560 may have a hollow cylindrical shape with the top hook 510 passing through the center of the roller 560. The top hook 510 may have a circular (as shown), rectangular, square, or other cross-sectional shape. Independent of the top hook's 510 cross-sectional shape, the roller 560 may be a hollow cylinder with a hole that is large enough to fit around the top hook 510. In the example shown in FIG. 5A, the top hook 510 also includes the anchor piece 514. The anchor piece 514 offers the support needed as discussed above for hanger 100 in FIG. 1 and prevents the roller 560 arranged on the straight piece of the top hook 510 connected to the anchor piece 514 from falling off the top hook 510. The top hook 510 with the rollers 560 included may be arranged such as to have the rod 900 contact rollers 560 on two adjacent straight sides connecting at the high point 512 of the top hook 510 to have the advantages discussed above with regards to having two contact points with the top hook 110.

Figure 6:
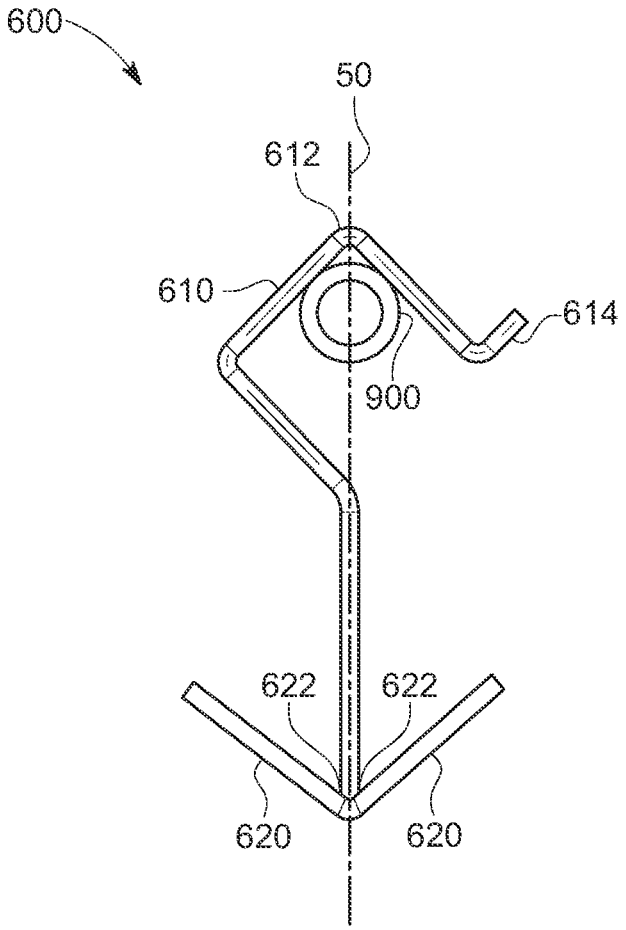
FIG. 6 shows another example front view of a hanger.

FIG. 6 shows another example front view of a hanger 600. The hanger 600 in this embodiment comprises of a top hook 610 with a high point 612, an anchor piece 614, and two side hooks 620. The top hook 610 may include the one or more roller 660 as described above for hanger 500 and shown in FIGS. 5A and 5B. The top hook 610 may directly connect to the side hooks 620 on an end of the top hook 610 that is opposite a high point 612 of the top hook 610. The hanger 600 has a low point 622 for each side hook 620 proximate to the centerline 50 and immediately on each side of the connection point where the top hook 610 and each of the one or more side hooks 620 connect. The centerline 50 is defined along a line where the side hooks 620 connect to the top hook 610 and in line with the high point 612. It is to be understood that the hanger 600 not comprise of the anchor piece 614.

Figure 7:
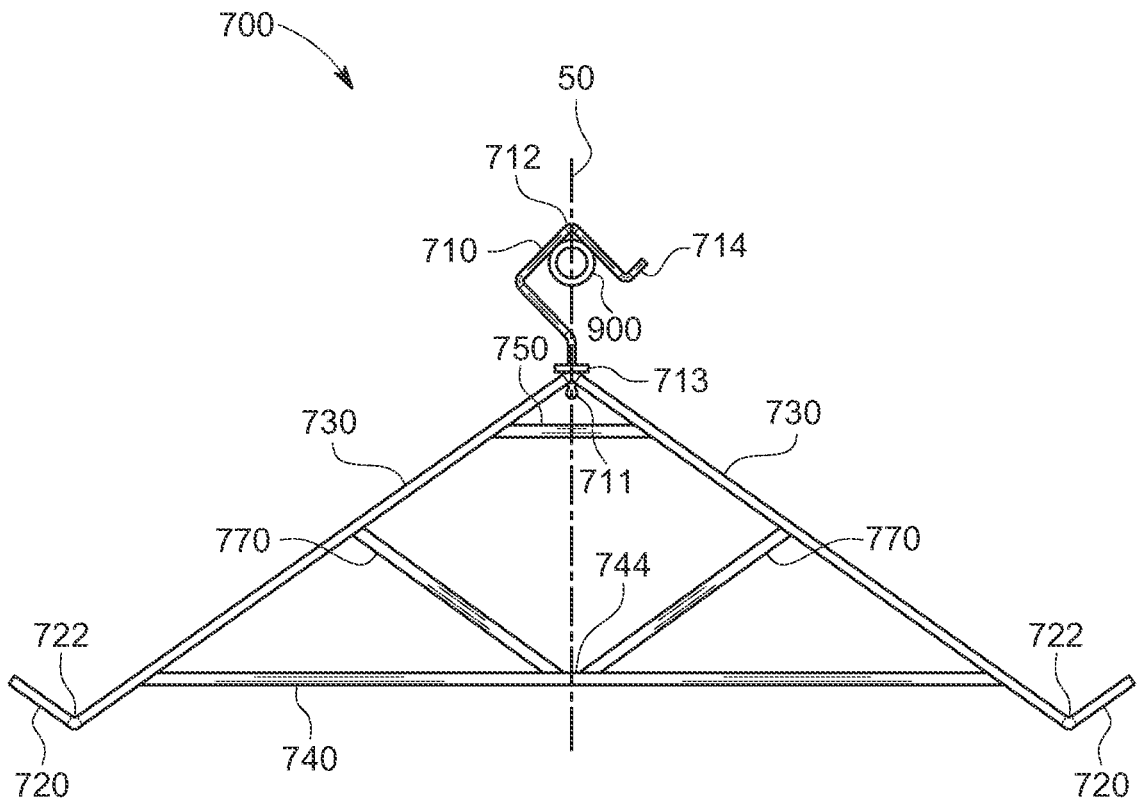
FIG. 7 shows another example front view of a hanger.

FIG. 7 shows another example front view of a hanger 700. The hanger 700 comprises of a top hook 710 with a high point 712 in line with the centerline 50. The hanger 700 also comprises of an anchor piece 714, two side arms 730, one or more side hooks 720 (each side hook 720 having a low point 722), a base 740, a support 750, and one or more braces 770. The top hook 710 is also configured with a ball 711 and a stopper 713 at a connection with the two arms 730 to allow a 360-degree rotation of the two arms 730. An alternate to this embodiment, may include a stationary connection of the top hook 710 to the two arms 730. In this embodiment, the one or more braces 770 connect to the two arms 730 and extend toward the base 740 and connect at a midpoint of the base 740. The one or more braces 770 may also connect relatively at a midpoint of the arms 730. Accordingly, a low point 744 on the base 740 may be at a point which is between a connection of the one or more braces 170 with the base which is relatively at the center of the base 140. The low point 744 may be relatively in line with the base 740 or in other words, the low point may be in the same plane on the base 740. The connection of the one or more braces 770 at the midpoint of the base 740 adds structural support to the hanger 700.

It is to be understood that any of these embodiments may be fashioned from any of the elements in varied structures not discussed above. For example, some of the embodiments described herein may not comprise of the anchor piece (e.g., see FIG. 1 anchor piece 114). Another example, all of the embodiments described herein may include the one or more rollers. (e.g., see FIGS. 5A and 5B, one or more rollers 560).

Figure 8:
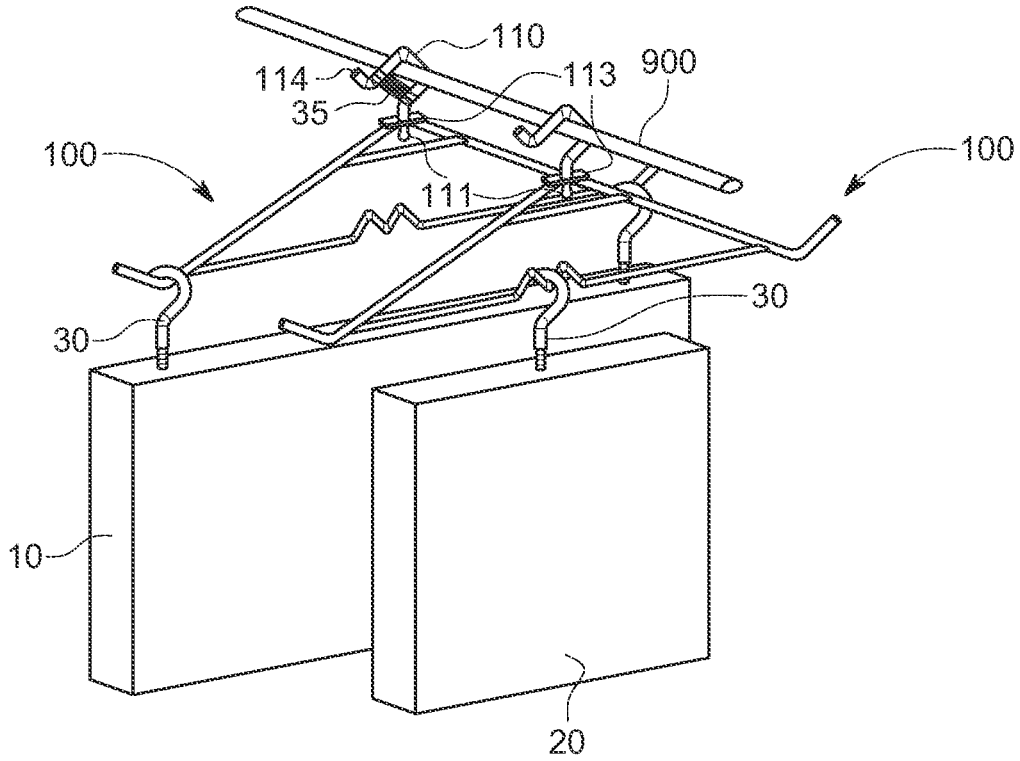
FIG. 8 shows an example view of hangers with connected objects suspended from a rack.

FIG. 8 shows an example view of one embodiment of hangers 100 with connected objects 10 and 20 suspended from a rack hanging rod 900. One object 10 may be suspended by two connectors 30 at the low points 122 of the side hooks 120 of one hanger 100. The hanger 100 with the object 10 is also utilizing a cord 35 wrapped around the top with the anchor piece. A second object 20 is suspended from a single connector 30 at the first low point 144 on of the base 140 of the hanger 100. The connectors 30 shown in FIG. 8 are hooks which have been screwed into the objects 10, 20 to help hang them onto the hangers 100. The connectors may also include thread, cord, wire, carabiners, cables, or other devices known in the arts used to connect objects.

Due to the advantageous features of the one or more embodiments of the hanger described above, the hangers can be placed closer together on a hanging rod while the objects are drying than would be possible with conventional hangers. This provides the advantage of not only creating more space on a single hanging rod but also saving time so more objects can be worked on and dried. Furthermore, hanging the objects at the low points in the side hooks, the low point of the base, or the secondary low points of the base provides a more stable contact point to hang the object with a connector and prevents the object from sliding around on the hanger causing unwanted movement and touching of the objects.

Accordingly, the present description provides for various embodiments for a hanger. Many uses and advantages are offered by the hanger as described above in one or more non-limiting embodiments in the present description.

The corresponding structures, materials, acts, and equivalents of any means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention, according to one or more embodiments described in the present description, may be practiced with modification and alteration within the spirit and scope of the appended claims. Thus, the description is to be regarded as illustrative instead of restrictive of the present invention.

What is claimed is:

1. A hanger comprising:

a top hook having multiple straight sides, wherein the multiple straight sides are connected at an angle with two adjacent straight sides connected via a high point, wherein the high point is a highest point of the top hook, and wherein the two adjacent straight sides connected via the high point are arranged to contact a hanging rod on opposing sides when suspended from the hanging rod;

two arms connected to the top hook and extending laterally from the top hook; and a base consisting of two opposing ends connected to the two arms on each opposing end, wherein each of the two opposing ends has a straight portion that extends toward a wavy portion at a center of the base, wherein:

each of the straight portion and the wavy portion are in a contiguous line, with each of the straight portion having a length that is greater than a span of the wavy portion, and the wavy portion consisting of two peaks and one low point.

2. The hanger of claim 1, wherein the two adjacent straight sides connected via the high point include one or more rollers having a hollow cylindrical shape to fit around the two adjacent straight sides.

3. The hanger of claim 1, wherein the one low point is a local minimum within the wavy portion, wherein the one low point is a first low point on the hanger and is a center point of the wavy portion with one peak extending up on either side of the low point.

4. The hanger of claim 3, wherein the high point of the top hook aligns with the first low point along a centerline, wherein the two arms and the base are symmetrical across the centerline.

5. The hanger of claim 1, further comprising:

one or more side hooks connected to the two arms, wherein each arm of the two arms is connected to at least one side hook, and the one or more side hooks each including second low points which are local minima with the side hooks.

6. The hanger of claim 5, wherein the one or more side hooks extend down and away from the connection with the two arms and then turn upward at an angle creating the second low point, wherein the second low point is below the base.

7. The hanger of claim 5, wherein the one or more side hooks extend upward at an angle from the connection with the two arms, wherein the second low point is in line with the base.

8. The hanger of claim 1, wherein the top hook is configured with an anchor piece, wherein the anchor piece is configured on an end of the top hook that is opposite an end that connects to the two arms, wherein the anchor piece extends upward and away from the top hook at an angle.

9. The hanger of claim 1, further comprising a support having two opposing ends connected to the two arms at a position relatively proximal to where the two arms connect to the top hook, and wherein the support is parallel to the base.

10. The hanger of claim 1, further comprising one or more braces which connect to the two arms and the base, wherein a first brace connects to the first arm and the base, and wherein a second brace connects to the second arm and the base.

11. The hanger of claim 1, wherein top hook has a ball and a stopper opposite each other at the connection with the two arms, wherein the two arms can rotate at the connection with the top hook.

* * * * *